United States Patent [19]

Orenstein

[11] Patent Number: 4,684,354

[45] Date of Patent: Aug. 4, 1987

[54] APPENDAGE OPERATED TOY

[76] Inventor: Henry Orenstein, 136 Lakeside Ave., Verona, N.J. 07044

[21] Appl. No.: 564,692

[22] Filed: Dec. 23, 1983

[51] Int. Cl.[4] ..... A63H 33/26

[52] U.S. Cl. ..... 446/130

[58] Field of Search ..... 446/130, 129, 132, 431, 446/457, 462; 335/207; 205

[56] References Cited

U.S. PATENT DOCUMENTS

| | | | |
|---|---|---|---|
| 3,198,902 | 8/1965 | Deshautreaux, Jr. | 335/207 |
| 3,205,323 | 9/1965 | Deshautreaux, Jr. | 335/207 |
| 3,223,412 | 12/1965 | Freeman et al. | 446/129 X |
| 3,867,786 | 2/1975 | Greenblatt | 446/130 |
| 4,295,118 | 10/1981 | Herr et al. | 335/207 X |
| 4,306,375 | 12/1981 | Goldfarb et al. | 446/462 X |
| 4,329,550 | 5/1982 | Verley | 335/207 X |

*Primary Examiner*—Mickey Yu

*Attorney, Agent, or Firm*—George E. Kersey

[57] ABSTRACT

Method and apparatus for the operation of a propulsion unit by a magnetic switch which includes a pair of longitudinally extending reeds that are held in a closed or open position by an associated auxiliary magnet. When an external magnet is moved along the longitudinally extending direction of the reeds, the switch is opened or closed.

14 Claims, 2 Drawing Figures

FIG. 1
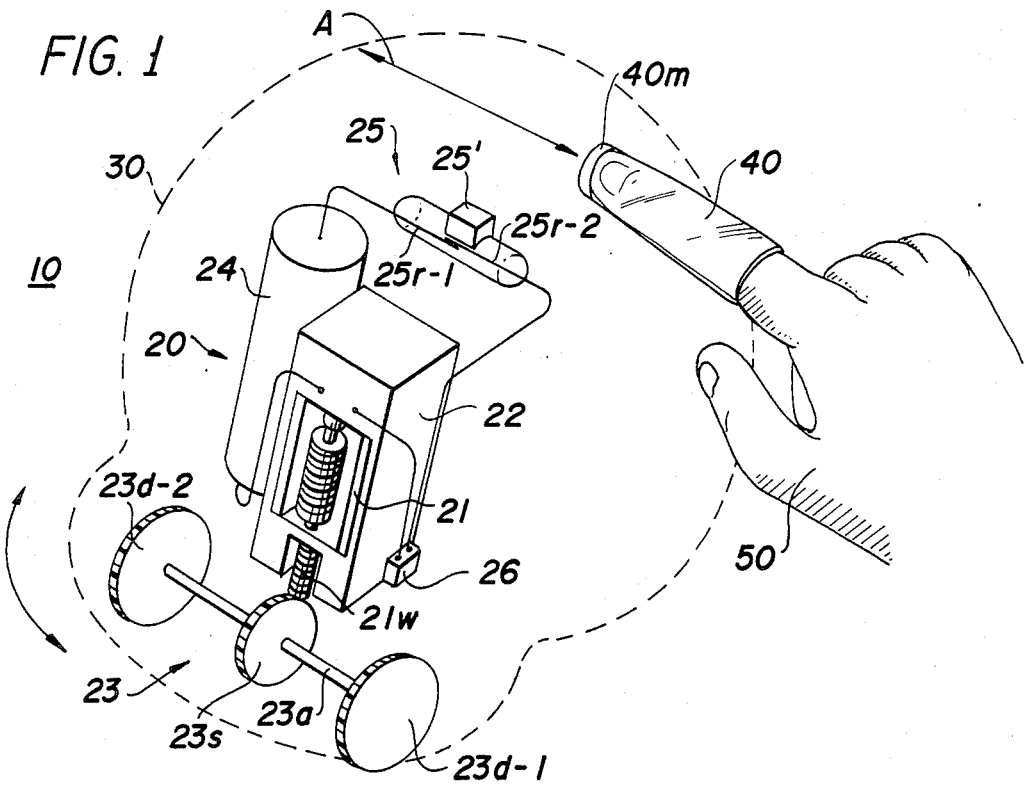
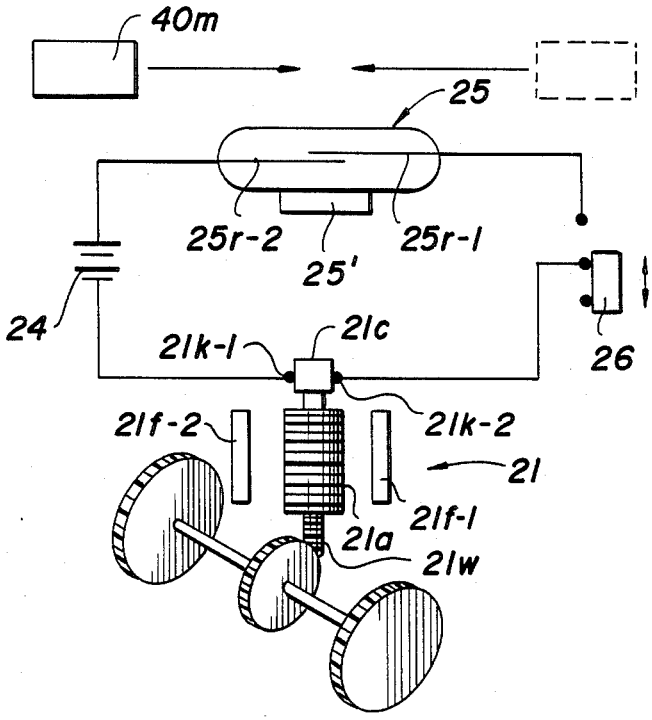
FIG. 2

APPENDAGE OPERATED TOY

BACKGROUND OF THE INVENTION

This invention relates to indirectly operated toys, and, more particularly to toys which give the appearance of being operated by movement of an appendage of the user, such as a finger.

Many toys require direct contact between a user and for example a switch positioned on the toy, before the toy is brought into operation. In the case of remotely operated toys, i.e. those which are brought into operation at a distance from the position of the user, it is generally necessary to have some form of radio transmission. A miniaturized transmitter can be used to send command signals to a miniaturized receiver within the toy.

The interest of the user of a toy is enhanced when he is able to operate it indirectly. In the case of radio transmission, indirect operation is both complex and expensive.

Accordingly, it is an object of the invention to provide for the operation of toys in a way that will be of interest to the user. A related object is to provide for the indirect operation of toys.

Another object of the invention is to achieve indirect operation without requiring the complexity and expense of miniaturized transmitting and receiving equipment.

SUMMARY OF THE INVENTION

In accomplishing the foregoing and related objects, the invention provides for the incorporation of a magnetic switch into a propulsion mechanism which is brought into operation by movement of an auxiliary member along the magnetic switch.

In accordance with one aspect of the invention, the auxiliary member is a magnet and the switch upon which it acts is formed by a pair of longitudinally extending reeds which are held in an open or closed position by an associated magnet. If the reeds are initially in contact, they are open by sweep of the auxiliary magnet in one longitudinal direction, and are closed by reversing the sweep of the auxiliary magnet in an opposite longitudinal direction.

In accordance with another aspect of the invention, the magnetic switch is included in the energizing circuit in the propulsion unit for a toy. The auxiliary magnet which operates the switch, and hence the toy, can be hidden in an auxiliary appendage of the user, for example a finger housing or finger extension. When the latter has the same appearance as a finger and is used to enclose a portion of the finger, the user is able to bring the toy into operating by directing his finger in the sweep direction near the magnetic switch incorporated into the toy. This gives a "magic finger" effect.

DESCRIPTION OF THE DRAWINGS

Other aspects of the invention will become apparent after considering several illustrative embodiments taken in conjunction with the drawings in which:

FIG. 1 is a perspective view of a toy, with its outer cover in phantom, showing a magnetic switch propulsion unit in accordance with the invention; and FIG. 2 is a schematic representation of the propulsion mechanism of the toy of FIG. 1.

DETAILED DESCRIPTION

With reference to the drawings, a "magic finger" toy 10 in accordance with the invention is shown in perspective in FIG. 1. The toy 10 is formed by an internal propulsion mechanism 20 that is housed within an outer casing 30. The toy 10 is controlled by an auxiliary member 40 which is illustratively in the form of a sleeve that fits on the end of the index finger of a user 50.

To operate the toy 10 the appendage 40 is moved in one of the directions indicated by the doubled headed arrow A. This starts or stops the operation of the propulsion mechanism 20 depending upon its prior state. The appendage 40 does not need to be brought into direct contact with the shell 30. It is sufficient to move it in one of the directions indicated by the double headed arrow in order to bring about the desired operation. This gives the appearance of being able to control the movement of the toy 10 in an indirect "magical" way.

The propulsion mechanism 20 includes a propulsion unit such as an electric motor 21 that is supported in a casing 22. The shaft of the motor 21 has a worm gear extension 21*w* that acts upon a spur gear 23*s* of a wheel assembly 23. An axle 23*a* extends outwardly from both sides of the spur gear 23*s* to respective drive wheels 23*d*-1 and 23*d*-2. In order to provide balance for the toy 10 it is desirable to include an additional, freely mounted wheel (not shown) at the base level of the drive wheels 23*d*-1 and 23*d*-2. Motive power for the motor 21 comes from a battery source 24 which has one terminal connected to the motor 21 and an opposite terminal connected to a magnetic switch 25. The circuit from the source 24 from the switch 25 is completed to the motor 21 through a mechanical slider switch 26. When the switch 26 is in the "on" position, i.e. there is continuity from the motor 21 to the magnetic switch 25, the motor will be operating, or not, depending upon whether the reeds 25*r*-1 and 25*r*-2 are in contact. When the reeds are in contact that condition is maintained by an associated ferrite magnet 25'. Conversely, when the reeds are out of contact, that condition is also maintained by the ferrite magnet 25'. The state of the reeds 25*r*-1 and 25*r*-2 is changed by a magnet 40*m* located in the sleeve 40. When the latter magnet 40*m* is moved in one of the directions indicated by the double headed arrow A it closes the reed contacts if they were previously open, or opens the contacts if they were previously closed.

The structure of the magnetic switch 25 and details of its functioning are clearly indicated in FIG. 2. The switch 25 includes a housing with two magnetic reeds 25*r*-1 and 25*r*-2. The housing also includes a ferrite magnet 25' which maintains the state of the reeds 25*r*-1 and 25*r*-2. When the reeds are separated as shown in FIG. 2, that condition of separation is maintained by the ferrite magnet 25'. Conversely, if the reeds 25*r*-1 and 25*r*-2 are in contact, the contact state is maintained by the ferrite magnet 25'. A change in the state of the reeds 25*r*-1 and 25*r*-2, from a closed condition to an open condition if the reeds are previously closed, or from an open condition to a closed condition if the reeds are previously opened, is accomplished by an external magnet 40*m*. As the magnet 40*m* is swept across the housing of the switch 25 as indicated by the horizontal arrow in FIG. 2, the switch 25 changes state. On the reverse sweep from the phantom position of the external magnet 40*m* the reeds 25*r*-1 and 25*r*-2 reverse their state.

It is advantageous for the sleeve magnet 40*m* to be integrally included in the sleeve 40 which in turn gives the same general appearance as the end of a finger. This gives the appearance of having the toy 10 controlled entirely by indirect motion of a finger of the user 50.

Schematic details of the propulsion assemblage are given in FIG. 2. The motor 21 includes an armature 21*a* with a commutator 21*c* at one end of the armature shaft. The other end of the armature shaft extends to the drive worm gear 21*w*. The circuit containing the energy source 24 extends through the commutator 21*c* through coil contact springs 21*k*-1 and 21*k*-2. The field for the motor 21 is provided ferrite slabs 21*f*-1 and 21*f*-2.

While various aspects of the invention have been set forth by the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. The method of simulating magical remote control over a device which comprises the steps of:

incorporating into the device a magnetic switch including a pair of longitudnally extending reeds which are held in a closed or open position by an associated auxiliary magnet opposite both of said reeds; and including a magnet in the tip of a simulated finger which can be placed upon the finger of an operator so that movement of the hand of the operator towards or away from the object causes a change in state of the magnetic switch therein, which change of state is retained until a subsequent pass is made with the hand including the finger appendage with the magnet;

thereby to create the effect of magical operation of the device by movement of the hand of the operator with the finger appendage to the vicinity of the device.

2. The method of claim 1 wherein said device includes a propulsion unit operated by said switch.

3. The method of claim 2 wherein said propulsion unit is coupled to at least one drive wheel.

4. The method of claim 3 wherein said propulsion unit is coupled to a plurality of drive wheels.

5. Method as defined in claim 2 further including a mechanical switch interposed between said magnetic switch and said propulsion unit.

6. Method as defined in claim 5 wherein said mechanical switch comprises three terminals of which two of the terminals are interconnectable by the movement of a slider and two of the three terminals are included in a circuit path of an energy source.

7. Method as defined in claim 2 wherein said propulsion unit comprises an electric motor.

8. Method as defined in claim 7 wherein said electric motor includes a rotatable armature with a worm gear extending therefrom.

9. Method as defined in claim 8 wherein said worm gear is in engagement with a spur gear mounted on an auxiliary shaft which is thereby rotatable during the operating of said armature.

10. Method as defined in claim 9 wherein said motor has a permanent magnet ferrite field.

11. Method as defined in claim 2 wherein said auxiliary magnet is of ferrite material.

12. Method as defined in claim 8 wherein said armature includes a commutator which is engaged by wire spring brushes connected in the circuit of said energy source.

13. Method as defined in claim 12 wherein said wire spring brushes are individual coil springs.

14. The method of claim 1 wherein said magnetic switch is used for the propulsion of a toy and the operation of said switch is controlled by the direction of movement of said finger therealong.

* * * * *